United States Patent [19]

Giannuzzi

[11] Patent Number: 4,574,551

[45] Date of Patent: Mar. 11, 1986

[54] LOAD-BEARING PLATE

[76] Inventor: Louis N. Giannuzzi, 4 Shelter Dr., Cos Cob, Conn. 06807

[21] Appl. No.: 613,255

[22] Filed: May 23, 1984

[51] Int. Cl.[4] ..... E04B 1/38; E04C 5/00

[52] U.S. Cl. ..... 52/512; 52/410; 52/506; 52/698; 411/154

[58] Field of Search ..... 52/512, 410, 506, 698; 411/154, 147

[56] References Cited

U.S. PATENT DOCUMENTS

| | | | |
|---|---|---|---|
| 1,286,862 | 12/1918 | Williams | 411/371 |
| 1,822,909 | 9/1931 | Schneider | 52/512 |
| 2,769,333 | 11/1956 | Reintjes | 52/410 |
| 3,101,763 | 8/1963 | McGehee | 411/162 |
| 3,370,631 | 2/1968 | James | 411/188 |
| 3,478,639 | 11/1969 | Gruca | 411/415 |
| 4,074,501 | 2/1978 | Sandquist | 52/410 |
| 4,075,807 | 2/1978 | Alderman | 52/407 |
| 4,161,087 | 7/1979 | Levesque | 52/410 |
| 4,162,597 | 7/1979 | Kelly | 52/410 |
| 4,288,951 | 9/1981 | Carlson et al. | 52/410 |
| 4,329,821 | 5/1982 | Long et al. | 52/410 |
| 4,361,997 | 12/1982 | DeCarro | 411/161 |
| 4,367,255 | 1/1983 | Blohm | 52/506 |
| 4,389,826 | 6/1983 | Kelly | 52/410 |

*Primary Examiner*—Donald G. Kelly
*Assistant Examiner*—Michael Safavi
*Attorney, Agent, or Firm*—Michael Ebert

[57] ABSTRACT

A load-bearing square plate usable in conjunction with an anchor bolt to firmly secure a layer of thermal insulation material to a roof surface to prevent the layer from being blown away as a result of strong updrafts. The plate has a center hole for receiving the shank of the anchor bolt to be driven by a hammer into the roof. The plate is embossed to define both a raised hub which surrounds the hole to catch the head of the hammer when it drives in the bolt and thereby prevent overdrive thereof, and a plate-reinforcing pattern to resist flexure thereof omnidirectionally. This embossed pattern is constituted by a four-sided marginal frame adjacent the edges of the plate, a star formed by radial spokes of progressively diminishing width extending from the hub to the corners of the frame, and a cross formed by short ribs lying between the radial spokes and extending from the hub to the midpoints of the frame sides. The ribs in combination with the spokes and the frame sides create a symmetrical array of triangular trusses.

5 Claims, 3 Drawing Figures

LOAD-BEARING PLATE

BACKGROUND OF INVENTION

1. Field of Invention

This invention relates generally to roof-bearing plates to firmly secure a layer of thermal insulation material to a roof surface, and more particularly to a plate of this type which is embossed to create a plate-reinforcing pattern which acts to resist flexure of the plate.

It is common practice to cover the roof of a building with a layer of thermal insulation material. This layer may be formed of pads of light-weight material such as fiberglass which are laid down on the surface of the roof and covered by a sheet of polyvinyl chloride or tarred cardboard to protect the layer against water penetration.

Since the roof is exposed to the elements, it may at times be subject to high velocity winds, as high as 150 miles per hour. Unless the insulation layer is firmly secured to the roof, the resultant updraft may blow the insulation layer from the roof. One cannot as a practical matter use bonding agents to adhere the layer to the roof, for these lack sufficient strength to resist strong updrafts. It is therefore the usual practice to secure the layer to the roof by load-bearing plates of sheet metal which lie over the layer and are bolted or otherwise fastened to the roof.

2. The Prior Art

The patent to Williams, U.S. Pat. No. 1,286,862, shows a contoured roofing washer designed for a corrugated iron roof, the washer having a center hole from which radiate triangular ribs.

The patent to Sandqvist, U.S. Pat. No. 4,074,501, shows a heat insulating layer on a roof which is held thereto by plastic plates having a center bore to receive a screw.

The patent to Carlson et al., U.S. Pat. No. 4,288,951, provides insulation for the roof of a metal building or mobile home, use being made of a self-locking washer to sandwich the insulation panel between the fastener and a base plate. This patent is of interest because of the configuration of the radial ribs on the washer which extend between the center hole and a marginal rectangular rib.

The DeCaro patent, U.S. Pat. No. 4,361,997, shows a plastic plate to secure insulation to a metal roof. The configuration shown in FIG. 3 is of particular interest because of the triangular ribs radiating from a center hole at the bottom of the plate. These ribs are intended for anti-rotational purposes.

Other forms of plates to hold insulation to a roof are shown the Kelly U.S. Pat. Nos. 4,162,597 and 4,389,826. Of lesser interest are the following U.S. Pat. Nos.

| | |
|---|---|
| 4,161,087 | 3,101,763 |
| 4,329,821 | 2,769,333 |
| 4,075,807 | 3,370,631 |
| 3,478,639 | |

SUMMARY OF INVENTION

In view of the foregoing, the main object of this invention is to provide a load-bearing plate adapted to receive an anchor bolt of the type which can be driven into masonry or other types of roof material by means of a hammer, the plate serving to firmly secure a covering layer of insulating material to the roof.

More particularly, an object of this invention is to provide a load-bearing plate of the above type fabricated of sheet metal that is embossed to create a plate-reinforcing pattern that resists flexure of the plate omnidirectionally so that regardless of the direction of the updraft forces imposed on the insulation layer underlying the plate, the plate will maintain its holding power.

Also an object of the invention is to provide a load-bearing plate that may be mass-produced at relatively low cost.

Briefly stated, these objects are attained in a load-bearing square plate usable in conjunction with an anchor bolt to firmly secure a layer of thermal insulation material to a roof surface to prevent the layer from being blown away as a result of strong updrafts. The plate has a center hole for receiving the shank of the anchor bolt to be driven by a hammer into the roof. The plate is embossed to define both a raised hub which surrounds the hole to catch the head of the hammer when it drives in the bolt and thereby prevent overdrive thereof, and a plate-reinforcing pattern to resist flexure thereof omnidirectionally. This embossed pattern is constituted by a four-sided marginal frame adjacent the edges of the plate, a star formed by radial spokes of progressively diminishing width extending from the hub to the corners of the frame, and a cross formed by short ribs lying between the radial spokes and extending from the hub to the midpoints of the frame sides. The ribs in combination with the spokes and the frame sides create a symmetrical array of triangular trusses.

OUTLINE OF DRAWINGS

For a better understanding of the invention as well as other objects and further features thereof, reference is made to the following detailed description to be read in conjunction with the accompanying drawings, wherein.

Figure 3:
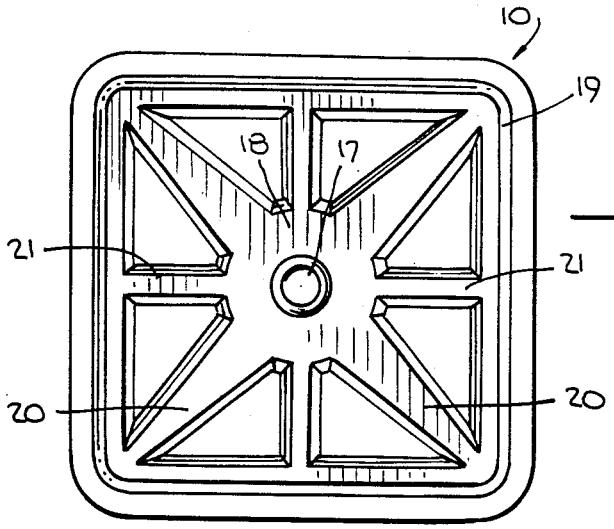

FIG. 3 a bottom plan view of the plate.

DESCRIPTION OF INVENTION

Figure 1:
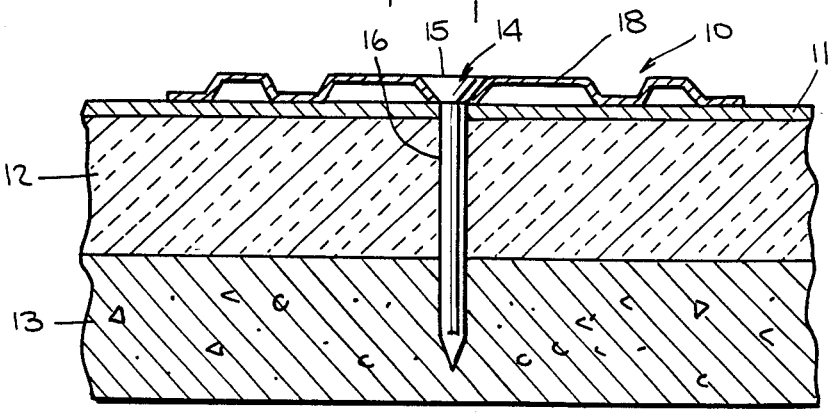
FIG. 1 is a sectional view illustrating a load-bearing plate in accordance with the invention, which plate is shown placed on a layer of thermal insulation material laid over a roof.
Figure 2:
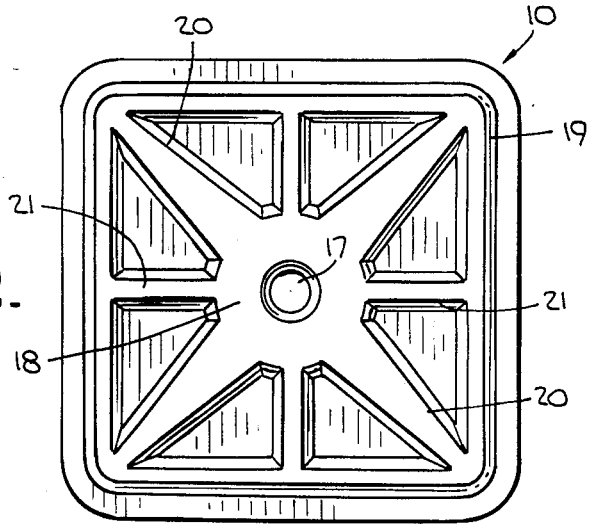
FIG. 2 is top plan view of the load-bearing plate.

Referring now to FIG. 1, where is shown a load-bearing plate in accordance with the invention, generally designated by reference numeral 10. The plate overlies a sheet 11 of tarred pressboard or other water-impervious material covering a layer 12 of thermal insulation material laid down on a roof 13. The roof may be of masonry or other suitable structural material. Layer 12 may be formed of pads of fiberglass of whatever other thermal insulation is used in the roof installation.

Load-bearing plate 10 is fastened to the roof by a hammer-drivable anchor bolt 14 having a conical head 15. The shank 16 of the bolt passes through the sheet 11 and the insulation layer 12 and is hammered into the roof surface. Since in a typical installation hundreds of such plates are used and are hammered in place at a fast rate, it is important that the plate be properly set even with careless hammering.

In practice, the anchor bolt may be of the single-piece type disclosed in applicant's copending application Ser. No. 388,256, filed June 14, 1982, whose entire disclosure is incorporated herein by reference.

Plate 10 is preferably made of stainless steel or other high strength sheet metal which is resistant to chemicals and is unaffected by the atmospheric conditions to which the plate is exposed on the roof. Plate 10 is a square having rounded corners to avoid sharp points. The plate is provided with a countersunk center hole 17 to receive the shank 16 of the bolt, the conical head 15 of the bolt nesting within this hole when the bolt is fully driven in.

The plate is embossed to define both a raised hub 18 surrounding the hole and a reinforcing pattern to resist flexure omnidirectionally. The area of the raised hub is such as to complement and engage the head of the hammer used to drive in the bolt when a point is reached at which the bolt head 15 is nested in the countersunk hole 17 as shown in FIG. 1.

The hub therefore acts to catch the head of the hammer and prevent overdrive of the bolt. Such overdrive would result in the load-bearing plate pressing into and distorting the underlying insulation layer which is structurally weak, and must therefore be avoided. With the present arrangement, the hammerer, the moment he hits the hub, knows he has gone far enough.

The embossed reinforcing pattern includes a four-sided marginal frame 19 adjacent the edges of the plate. Also included is an embossed star formed by four radial spokes 20 of progressively diminishing width extending from hub 18 to the four corners of frame 19. These spokes act as cantilever arms which serve to prevent flexure of the plate in all directions. Since they are relatively long, their triangular configuration performs an important function, for the spokes become wider as one goes from the corners to the hub where the flexure forces are greatest.

The embossed reinforcing pattern further includes a cross formed by relatively short ribs 21 of uniform width which extend between hub 18 and the midpoints of the four sides of frame 19. Each of these ribs effectively create with respect to the two radial spokes 20 on either side thereof and the related side of the frame 19 a triangular truss which greatly strengthens the structure of the plate and renders it highly resistant to stresses. The embossed pattern therefore creates a symmetrical array of triangular trusses.

Thus the embossed pattern on the plate imparts thereto a high degree of flexure resistance in all directions whereby when the plate is bolted to the roof it serves to hold the insulation thereto regardless of the power and direction of updraft forces which seek to blow away the insulation.

While there has been shown and described a preferred embodiment of a load-bearing plate in accordance with the invention, it will be appreciated that many changes and modifications may be made therein without, however, departing from the essential spirit thereof. Thus while the load-bearing plate has been disclosed for holding a layer of insulation material onto a roof surface, it has many other applications in which there is a need to secure a layer of material of some sort to a masonry surface, not necessarily a roof.

I claim:

1. A square load-bearing plate in combination with a hammer-drivable anchor bolt to firmly secure a layer of thermal insulation or other material to a roof or other rigid surface to prevent the layer from being detached therefrom, said bolt having a head engageable by the head of the hammer and a shank penetrating said layer and intering said roof, said plate comprising:

A. a countersunk center hole for receiving the shank of the bolt whose head rests in the hole when the shank is driven into the roof;

B. a raised hub embossed in the plate to surround the hole, said hub having a flat area large enough to catch the head of the hammer to prevent overdrive of the bolt into the roof; and C. a reinforcing pattern embossed in the plate to resist flexure thereof, said pattern being constituted by a four-sided marginal frame adjacent the edges of the plate, said frame having a flat undersurface which abuts the exposed surface of the layer, a star formed by radial spokes extending from the hub to the corners of the frame, and a cross formed by short ribs extending from the hub to the midpoints of the sides of the frame, the ribs in combination with the spokes and the sides of the frame creating a symmetrical array of triangular trusses.

2. A plate as set forth in claim 1 fabricated of stainless steel.

3. A plate as set forth in claim 1 having rounded corners.

4. A plate as set forth in claim 1, wherein said spokes become progressively wider as one goes from the frame to the hub.

5. A plate as set forth in claim 1, wherein said anchor bolt has a conical head which complements the countersunk hole.

* * * * *